US006860761B2

(12) United States Patent
Lee et al.

(10) Patent No.: US 6,860,761 B2
(45) Date of Patent: Mar. 1, 2005

(54) RIGHT ANGLE COAXIAL CONNECTOR

(75) Inventors: Joon Lee, Des Plaines, IL (US); Nahid Islam, Westmont, IL (US)

(73) Assignee: Andrew Corporation, Orland Park, IL (US)

( * ) Notice: Subject to any disclaimer, the term of this patent is extended or adjusted under 35 U.S.C. 154(b) by 217 days.

(21) Appl. No.: 10/341,280

(22) Filed: Jan. 13, 2003

(65) Prior Publication Data

US 2004/0137790 A1 Jul. 15, 2004

(51) Int. Cl.[7] ..... H01R 9/05
(52) U.S. Cl. ..... 439/582
(58) Field of Search ..... 439/578–585

(56) References Cited

U.S. PATENT DOCUMENTS

| | | | | |
|---|---|---|---|---|
| 4,261,630 A | | 4/1981 | Knappenberger | 339/31 |
| 4,360,244 A | * | 11/1982 | Forney et al. | 439/581 |
| 4,655,534 A | | 4/1987 | Stursa | 339/177 |
| 4,691,976 A | | 9/1987 | Cowen | 439/394 |
| 4,932,898 A | | 6/1990 | Goodman et al. | 439/582 |
| 5,021,011 A | | 6/1991 | Kawanami et al. | 439/582 |
| 5,037,329 A | | 8/1991 | Wright | 439/582 |
| 5,061,206 A | | 10/1991 | Kawanami et al. | 439/582 |
| 5,110,308 A | | 5/1992 | Nishikawa et al. | 439/582 |
| 5,316,499 A | * | 5/1994 | Scannelli et al. | 439/534 |
| 5,362,255 A | | 11/1994 | Anhalt | 439/582 |
| 5,433,627 A | * | 7/1995 | Guerra et al. | 439/582 |
| 5,494,454 A | | 2/1996 | Johnsen | 439/394 |
| 5,597,323 A | | 1/1997 | Resnick et al. | 439/582 |
| 5,802,710 A | | 9/1998 | Bufanda et al. | 29/828 |
| 5,879,190 A | | 3/1999 | Maruyama et al. | 439/582 |
| 6,106,333 A | * | 8/2000 | Purdy | 439/578 |
| 6,283,790 B1 | * | 9/2001 | Idehara et al. | 439/582 |
| 6,287,144 B1 | * | 9/2001 | Baffert | 439/578 |
| 6,361,348 B1 | | 3/2002 | Hall et al. | 439/352 |

FOREIGN PATENT DOCUMENTS

| | | |
|---|---|---|
| EP | 0090538 | 10/1983 |
| EP | 0924809 | 6/1999 |
| WO | WO96/31925 | 10/1996 |

* cited by examiner

*Primary Examiner*—Gary F. Paumen
(74) *Attorney, Agent, or Firm*—Wood, Herron & Evans, L.L.P.

(57) ABSTRACT

A right angle coaxial connector having a construction that simplifies attachment to a coaxial cable. The coaxial connector includes an outer housing and a coupling element to which the center conductor of the coaxial cable is coupled in an environment external to the outer housing. The coupling element has spring arms resiliently insertable into a bore defined in a central pin of the coaxial connector. The spring arms provide electrical contact between the central pin and the center conductor of the coaxial cable.

27 Claims, 2 Drawing Sheets

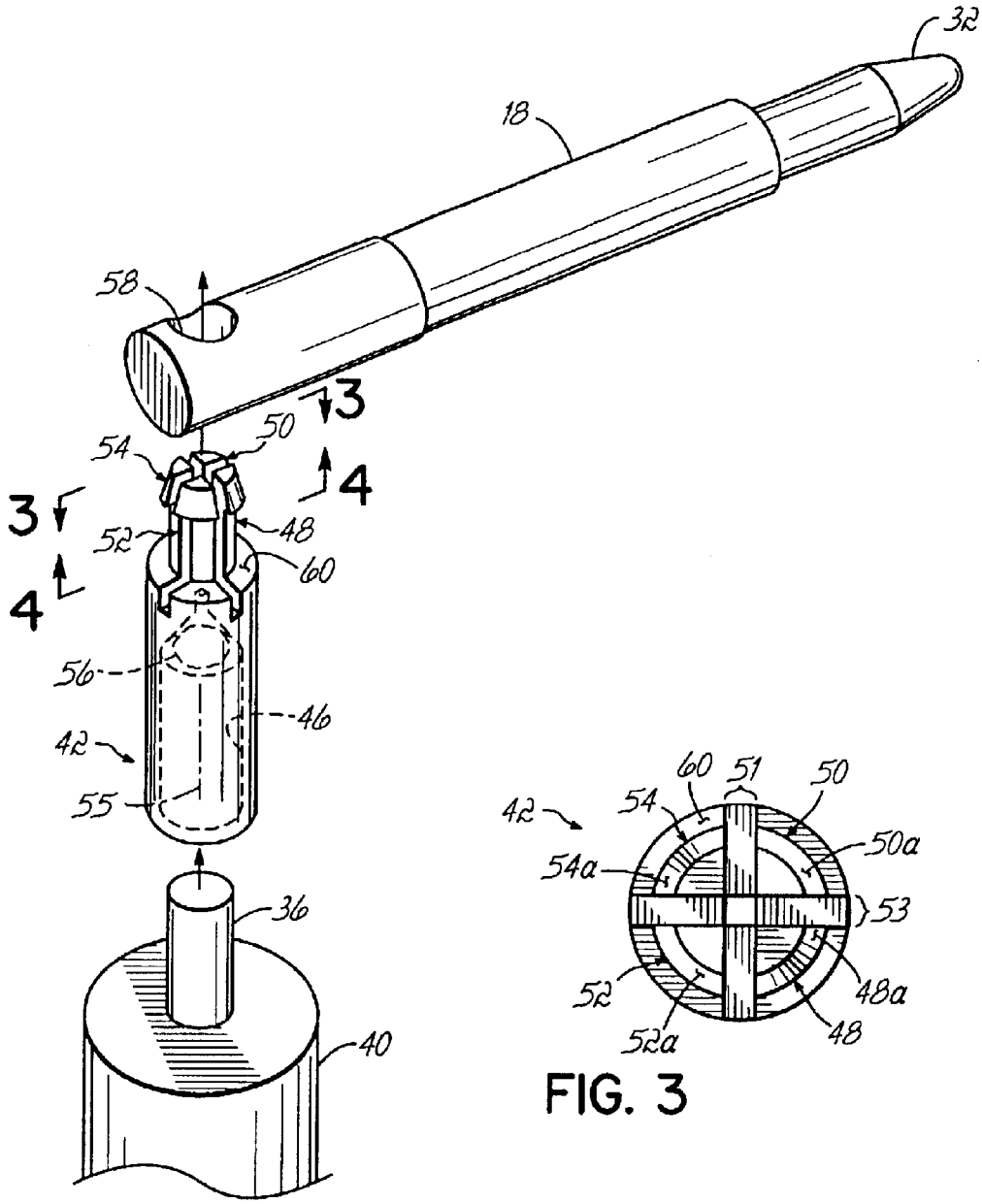
FIG. 2
FIG. 3
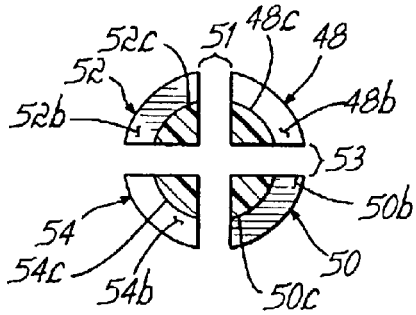
FIG. 4

RIGHT ANGLE COAXIAL CONNECTOR

FIELD OF THE INVENTION

This invention relates generally to electrical connectors and, in particular, to right angle electrical connectors for coaxial cables.

BACKGROUND OF THE INVENTION

Coaxial cable assemblies are commonly used for transmitting electrical signals over a length of coaxial cable. Coaxial cable typically includes a center conductor and an outer conductor that are electrically isolated from one another by a dielectric. The outer conductor is grounded so that it operates as an electrical shield around the center conductor to prevent a degradation of the signal carried by the central conductor. A coaxial cable assembly includes a pair of coaxial connectors each having an outer conductive shell that is coupled electrically, typically by crimping a ferrule, with one end of the outer conductor of the coaxial cable. The center conductor at each end of the coaxial cable is connected to a central pin or contact of the corresponding one of the coaxial connectors. The central contact is electrically isolated from the outer housing by a dielectric.

Under certain circumstances in which a straight-line or linear connection is impossible, a right angle coaxial connector is used for making an angled connection. Usually, the central conductor of the coaxial cable is connected perpendicularly with the central contact of the right angle coaxial connector within an interior chamber provided proximate to the right-angle bend in the coaxial connector. The connection is established by soldering the center conductor and the center contact together after the coaxial cable is inserted through a cable opening in the connector housing so that the central conductor is positioned in the interior chamber. Access to the interior chamber from the exterior of the connector is afforded through an access opening, which is sealed by a removable closure. With the closure removed, a tip of a soldering iron is inserted through the access opening to create the solder joint. Subsequently, the removable closure is replaced over the access opening to seal the interior chamber against signal leakage and to prevent inward penetration of contaminants from the environment surrounding the right angle coaxial connector.

Conventional right angle coaxial connectors suffer from several deficiencies and shortcomings. For example, conventional right angle coaxial connectors are difficult to assemble due to the soldering operation and the concomitant need to provide an interior chamber accessible through an access opening covered by a removable closure. The assembly process requires precision alignment of the cable conductor with the central pin during the soldering operation and significant proficiency in soldering in the cramped and restricted space defined by the interior chamber. Visual inspection of the soldered joint is, at best, difficult and may be impossible. In addition, the presence of the removable closure increases manufacturing costs of the connector and the effort required to accomplish the solder connection. Moreover, the removable closure may be misplaced or lost when the right angle coaxial connector is assembled with the coaxial cable.

Therefore, it would be desirable to have a right angle coaxial connector that simplifies the establishment of a connection between the central conductor of a coaxial cable and the central pin of a coaxial connector.

BRIEF DESCRIPTION OF THE DRAWINGS

FIG. 2 is an exploded view of the center pin and coupling element of the right angle coaxial connector of FIG. 1;

FIG. 3 is a top view taken generally along line 3—3 of FIG. 2; and

FIG. 4 is a cross-sectional view taken generally along line 4—4 of FIG. 2.

DETAILED DESCRIPTION OF THE INVENTION

Figure 1:
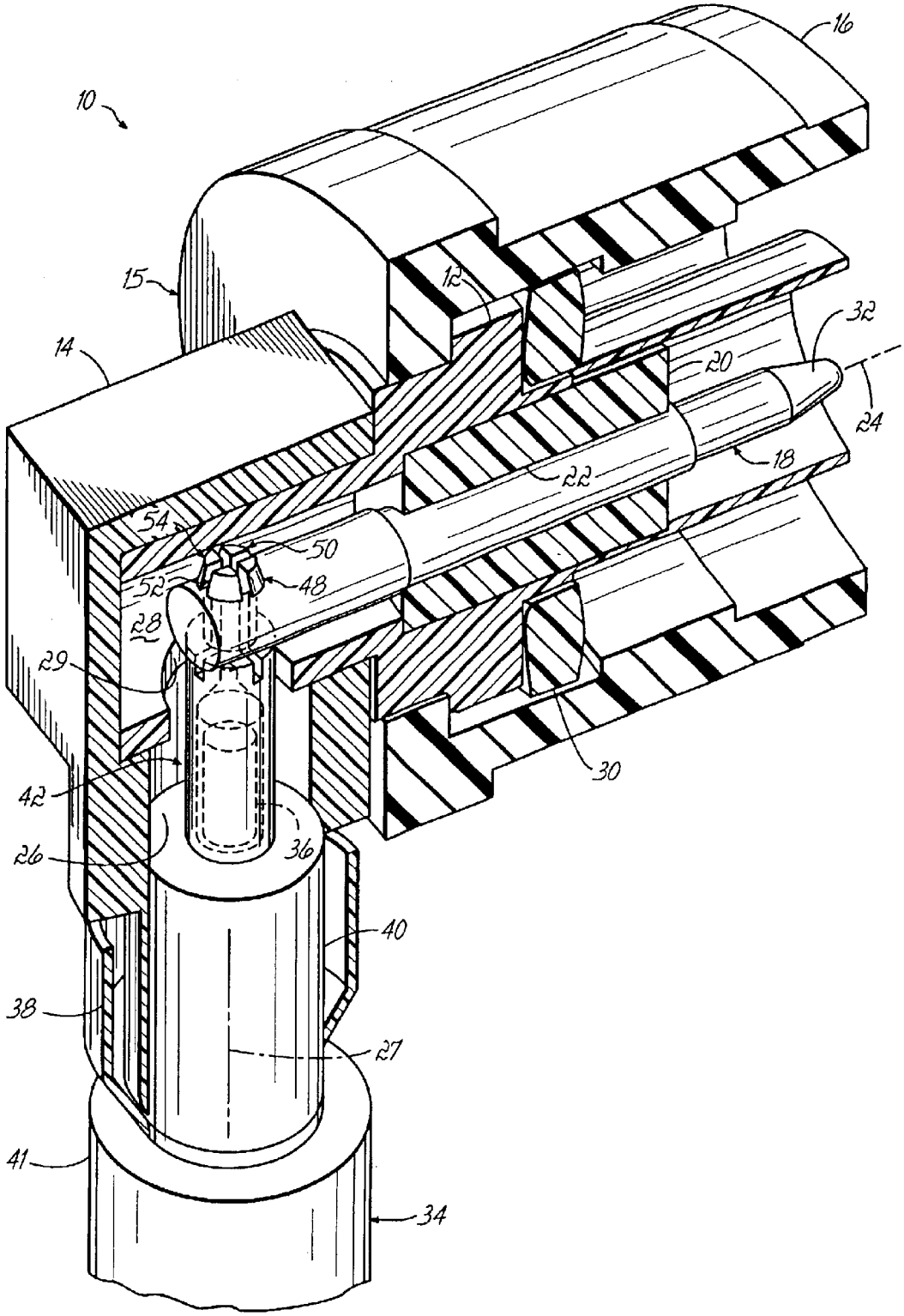
FIG. 1 is a cross-sectional view of a right angle coaxial connector in accordance with the principles of the invention.

Although the invention will be described in connection with certain embodiments, it will be understood that the invention is not limited to those embodiments. On the contrary, the description of the invention is intended to cover all alternatives, modifications, and equivalent arrangements as may be included within the spirit and scope of the invention as defined by the appended claims.

With reference to FIGS. 1 and 2, a right angle coaxial connector 10, according to the principles of the invention, includes a pair of conductive outer housing sections 12, 14 united to provide an outer housing 15, a conductive coupling nut 16 mounted to outer housing section 12, a central pin 18, and an annular dielectric bushing 20 electrically insulating the central pin 18 from outer housing section 12. A central bore 22 of the dielectric bushing 20 mechanically supports and aligns the central pin 18 along a longitudinal axis 24. Outer housing section 14 encloses a cylindrical cable passageway 26 having a longitudinal axis 27 aligned generally at a right angle relative to the longitudinal axis 24. It is contemplated by the invention that longitudinal axis 24 and longitudinal axis 27 may be oriented relative to one another in an angular relationship that is non-perpendicular, including but not limited to 45E and 135E. The cable passageway 26 communicates through a passage 29 in outer housing section 12 with a chamber 28 located inside outer housing section 12. An annular gasket 30 provides a seal that protects the integrity of the electrical connection between a blunted, generally-conical tip 32 of central pin 18 and a receptacle, of a complementary female electrical connector (not shown) with which right angle coaxial connector 10 is coupled. The coupling nut 16 secures the right angle coaxial connector 10 mechanically with the complementary female electrical connector to prevent separation after the electrical connection is established.

Assembled with the right angle coaxial connector 10 is a coaxial cable 34 that includes a central conductor 36, an outer conductor 38 surrounding the central conductor 36, a dielectric layer 40 electrically isolating the central conductor 36 from outer conductor 38, and an outer jacket 41. A length of the central conductor 36 is stripped of dielectric layer 40 for purposes of establishing an electrical connection between the central pin 18 and the central conductor 36. The coaxial cable 34 may be any conventional electrically conductive coaxial cable, including coaxial cables used for transmitting radio-frequency signals.

A coupling element 42 is provided that facilitates the creation of the electrical connection between the central pin 18 and central conductor 36. The coupling element 42 obviates the conventional requirement of having an access opening in the connector housing dimensioned to insert a soldering iron tip for creating a solder joint coupling central pin 18 and central conductor 36. To that end, the coupling element 42 and the central conductor 36 are coupled externally to outer housing section 14. Specifically, the central conductor 36 is coupled with the coupling element 42 and the coupling element 42 is subsequently connected electrically and mechanically with the central pin 18. The outer conductor 38 is electrically coupled with outer housing section 14 by a conventional technique, such as by soldering, crimping, captivating, spring fingers or threading.

With continued reference to FIGS. 1 and 2, the coupling element 42 includes a body member 44 having a hollow recess 46 at one end and a plurality of, for example, four spring arms 48, 50, 52, and 54 projecting outwardly at an opposite end. A quantity of solder 56 is disposed within the recess 46. The recess 46 is dimensioned to receive the stripped length of the central conductor 36. It is contemplated by the invention that the dimensions of the recess 46 may be varied to correspond to the dimensions of the central conductor 36 so that the right angle coaxial connector 10 may be used with a plurality of different coaxial cables 34 having a range of central conductor diameters. The invention contemplates that the central conductor 36 may be coupled with the coupling element 42 by crimping, clamping, threading and screw-on attachment without departing from the spirit and scope of the invention.

With reference to FIGS. 1–4, the spring arms 48, 50, 52, and 54 are resiliently attached to the body member 44 so that an inwardly directed force of a sufficient magnitude causes the spring arms 48, 50, 52, and 54 to move toward one another. Adjacent ones of the spring arms 48, 50, 52, and 54 are separated circumferentially by a pair of channels 51, 53 that provide respective voids or empty space between adjacent ones of the springs arms 48, 50, 52, and 54 and a central void defined by the intersection of channels 51, 53. The coupling element 42 may be formed from any suitable electrically-conductive alloy, including but not limited to beryllium copper or phosphorus bronze.

Each of the spring arms 48, 50, 52, and 54 carries a corresponding one of a plurality of convex beveled surfaces 48*a*, 50*a*, 52*a*, and 54*a*. Beveled surfaces 48*a*, 50*a*, 52*a*, and 54*a* are each inclined at an acute angle relative to longitudinal axis 55 of the coupling element 42 effective for achieving deflection of the spring arms 48, 50, 52, and 54 that reduces the width of channels 51, 53. For example, each of the beveled surfaces 48*a*, 50*a*, 52*a*, and 54*a* may be sloped at an inclination angle of about 30E. The beveled surfaces 48*a*, 50*a*, 52*a*, and 54*a* are arranged with a radius of curvature that, at the respective leading edges, is less than the radius of a bore 58 provided in the central pin 18. The radius of curvature of the beveled surfaces 48*a*, 50*a*, 52*a*, and 54*a* increases in a direction away from the leading edges toward the recess 46 and, eventually, exceeds the radius of bore 58. The beveled surfaces 48*a*, 50*a*, 52*a*, and 54*a* collectively define a frustoconical surface that operates as a positional aid for guiding the spring arms 48, 50, 52, and 54 into bore 58. As a result, a slight misalignment between beveled surfaces 48*a*, 50*a*, 52*a*, and 54*a* and bore 58 may be tolerated when the coupling element 42 is attached to the central pin 18. The spring arms 48, 50, 52, and 54 are rotationally symmetrical about longitudinal axis 55 so that the coupling element 42 is not required to be rotated with a specific angular alignment relative to longitudinal axis 27 of cylindrical cable passageway 26 when inserted therein in order to enter bore 58.

With continued reference to FIGS. 1–4, a lower surface 48*b*, 50*b*, 52*b*, and 54*b* of each of the spring arms 48, 50, 52, and 54 is configured for contacting a corresponding portion of the central pin 18 about bore 58 when the spring arms 48, 50, 52, and 54 are fully inserted into bore 58. A circumferential segmented shoulder 60 is provided on the coupling element 42 near the respective bases of spring arms 48, 50, 52 and 54. The shoulder 60 is spaced from the detent surfaces 48*b*, 50*b*, 52*b*, and 54*b* by a distance approximately equal to the diametrical dimension of the central pin 18. Central pin 18 is captured between detent surfaces 48*b*, 50*b*, 52*b*, and 54*b* and shoulder 60, which operates for resisting a removal force applied to the coaxial cable 34 in a direction capable of removing cable 34 from cable passageway 26.

Each of the spring arms 48, 50, 52, and 54 has a corresponding outwardly-facing convex surface 48*c*, 50*c*, 52*c*, and 54*c*, which are arranged with a common radius of curvature. When the spring arms 48, 50, 52, and 54 are fully inserted into bore 58 and the detent surfaces 48*b*, 50*b*, 52*b*, and 54*b* emerged from bore 58, the inward force applied thereto is released and the spring arms 48, 50, 52, and 54 reside outwardly so that the convex surfaces 48*c*, 50*c*, 52*c*, and 54*c* contact the interior of bore 58 with a radially-outward biased relationship. The common radius of curvature of the convex surface 48*c*, 50*c*, 52*c*, and 54*c* is greater than the diameter of bore 58 so that a radially outward force is applied to the inwardly-facing surface of bore 58 when the springs arms 48, 50, 52, and 54 are captured in bore 58.

In use and with reference to FIGS. 1 and 2, the central conductor 36 is coupled with the coupling element 42. Specifically, solder 56 is placed into the recess 46 and the stripped length of the central conductor 36 is inserted into the recess 46. A tip of a soldering iron (not shown) is placed with a contacting relationship with the exterior of the coupling element 42 to permit heat transfer that melts the solder 56 to provide a solder joint, when the molten solder 56 cools, between the stripped end of central conductor 36 and the recess 46. The soldering operation is accomplished externally to outer housing section 14. As mentioned herein, the coupling between the center conductor 36 and the coupling element 42 may be provided without soldering.

The coupling element 42 is inserted into the cable passageway 26 of outer housing section 14 generally parallel to longitudinal axis 27 so that the beveled surfaces 48*a*, 50*a*, 52*a*, and 54*a* of spring arms 48, 50, 52, and 54 are aligned with bore 58 and protrude through passage 29. The beveled surfaces 48*a*, 50*a*, 52*a*, and 54*a* enter the bore 58 and eventually contact a lower rim of an inner cylindrical surface of the central pin 18 surrounding bore 58 for applying an inwardly directed force to the spring arms 48, 50, 52, and 54 that narrows channels 51, 53.

Continued movement parallel to longitudinal axis 27 causes further deflection of the spring arms 48, 50, 52, and 54 until the beveled surfaces 48*a*, 50*a*, 52*a*, and 54*a* are fully inserted into the bore 58. Eventually, the beveled surfaces 48*a*, 50*a*, 52*a*, and 54*a* emerge from bore 58 and, as the inwardly directed force is relieved by passage of the detent surfaces 48*b*, 50*b*, 52*b*, and 54*b* above the surface of central pin 18 about bore 58, the spring arms 48, 50, 52, and 54 resiliently cantilever outwardly. The central pin 18 is captured between the shoulder 60 and lower surface 48*b*, 50*b*, 52*b*, and 54*b* so that the coaxial cable 34 and coupling element 42 cannot be easily withdrawn by a force directed parallel to longitudinal axis 27. The outwardly-facing convex surfaces 48*c*, 50*c*, 52*c*, and 54*c* touch respective portions of the inwardly-facing, cylindrical surface of bore 58 with a resilient force sufficient to establish a good electrical contact of relatively low contact resistance.

According to the principles of the invention, the right angle coaxial connector may be rapidly assembled to a coaxial cable and provides effective electromagnetic shielding. The right angle coaxial connector provides a cost-effective structure for coupling with a coaxial cable. Assembly of the coaxial cable with the coupling element external to the outer housing of the coaxial connector eliminates the tedious soldering operation needed in conventional right angle coaxial connectors. External assembly also permits the solder joint to be inspected both visually and mechanically.

While the present invention has been illustrated by a description of various preferred embodiments and while these embodiments have been described in considerable detail in order to describe the best mode of practicing the invention, it is not the intention of the applicants to restrict or in any way limit the scope of the appended claims to such detail. Additional advantages and modifications within the spirit and scope of the invention will readily appear to those skilled in the art. The invention itself should only be defined by the appended claims.

We claim:

1. An electrical connector for attachment to a coaxial cable having a central conductor, comprising:

an electrically-conductive outer housing having a cable passageway, an electrically-conductive central pin with a bore, and a dielectric bushing separating said central pin from said outer housing; and a coupling element configured for joining the central conductor with said central pin, said coupling element configured to couple with the central conductor and having a plurality of spring arms, said coupling element capable of being inserted into said cable passageway for positioning said spring arms in said bore of said central pin so as to establish electrical contact therebetween.

2. The electrical connector of claim 1 wherein each of said plurality of spring arms includes a beveled surface, said beveled surfaces contacting said bore of said central pin for guiding said spring arms when inserted into said bore.

3. The electrical connector of claim 1 wherein said coupling element includes a shoulder and each of said plurality of spring arms includes one of a plurality of detent surfaces facing toward said shoulder, said central pin being captured between said shoulder and said plurality of detent surfaces.

4. The electrical connector of claim 1 wherein said outer housing includes a first housing section enclosing said cable passageway, and a second housing section enclosing said dielectric bushing and said central pin, said cable passageway aligned along a first longitudinal axis and said central pin aligned along a second longitudinal axis oriented at an angle relative to said first longitudinal axis.

5. The electrical connector of claim 4 wherein said bore of said central pin is oriented generally parallel to said first longitudinal axis.

6. The electrical connector of claim 4 wherein said first longitudinal axis is aligned substantially perpendicular to said second longitudinal axis.

7. The electrical connector of claim 4 wherein each of said plurality of spring arms includes one of a corresponding plurality of beveled surfaces, each of said plurality of beveled surfaces contacting said bore of said central pin for guiding said spring arms into said bore.

8. The electrical connector of claim 7 wherein said coupling element includes a third longitudinal axis that is substantially aligned with a center of said bore, each of said plurality of beveled surfaces being tapered at an acute angle relative to said third longitudinal axis.

9. The electrical connector of claim 8 wherein said acute angle is about 30°.

10. The electrical connector of claim 8 wherein said plurality of beveled surfaces are rotationally symmetrical about said third longitudinal axis.

11. The electrical connector of claim 1 wherein each of said plurality of spring arms includes one of a corresponding plurality of detent surfaces that cooperate for resisting removal of the coaxial cable from said cable passageway when said spring arms are positioned in said bore of said central pin.

12. The electrical connector of claim 1 wherein said coupling element further comprise a solder cup dimensioned to receive a portion of the central conductor for forming a solder joint between the central conductor and said coupling element.

13. A cable assembly comprising:

a coaxial cable having a central conductor;

an electrically-conductive outer housing having a cable passageway, an electrically-conductive central pin with a bore, and a dielectric bushing separating said central pin from said outer housing; and a coupling element configured for joining said central conductor with said central pin, said coupling element configured to couple with said central conductor and having a plurality of spring arms, said coupling element capable of being inserted into said cable passageway for positioning said spring arms in said bore of said central pin so as to establish electrical contact therebetween.

14. The electrical connector of claim 13 wherein each of said plurality of spring arms includes a beveled surface, said beveled surfaces contacting said bore of said central pin for guiding said spring arms when inserted into said bore.

15. The electrical connector of claim 13 wherein said coupling element includes a shoulder and each of said plurality of spring arms includes one of a plurality of detent surfaces facing toward said shoulder, said central pin being captured between said shoulder and said plurality of detent surfaces.

16. The electrical connector of claim 13 wherein said outer housing includes a first housing section enclosing said cable passageway, and a second housing section enclosing said dielectric bushing and said central pin, said cable passageway aligned along a first longitudinal axis and said central pin aligned along a second longitudinal axis oriented at an angle relative to said first longitudinal axis.

17. The electrical connector of claim 16 wherein said bore of said central pin is oriented generally parallel to said first longitudinal axis.

18. The electrical connector of claim 16 wherein said first longitudinal axis is aligned substantially perpendicular to said second longitudinal axis.

19. The electrical connector of claim 16 wherein each of said plurality of spring arms includes one of a corresponding plurality of beveled surfaces, each of said plurality of beveled surfaces contacting said bore of said central pin for guiding said spring arms into said bore.

20. The electrical connector of claim 19 wherein said coupling element includes a third longitudinal axis that is substantially aligned with a center of said bore, each of said plurality of beveled surfaces being tapered at an acute angle relative to said third longitudinal axis.

21. The electrical connector of claim 20 wherein said acute angle is about 30°.

22. The electrical connector of claim 20 wherein said plurality of beveled surfaces are rotationally symmetrical about said third longitudinal axis.

23. The electrical connector of claim 13 wherein each of said plurality of spring arms includes one of a corresponding plurality of detent surfaces that cooperate for resisting removal of the coaxial cable from said cable passageway when said spring arms are positioned in said bore of said central pin.

24. The electrical connector of claim 13 wherein said coupling element further comprises a solder cup dimensioned to receive a portion of said central conductor for forming a solder joint between said central conductor and said coupling element.

25. A method of coupling a right angle coaxial connector with a coaxial cable, comprising:

coupling a coupling element with a central conductor of the coaxial cable external to an outer housing of the right angle coaxial connector;

inserting the coupling element into the outer housing; and resiliently engaging a plurality of springs arms of the coupling element with a bore formed in a central pin provided inside the outer housing to establish electrical contact therebetween.

26. The method of claim 25 further comprising electrically coupling the central pin with a receptacle of a complementary electrical connector to create an electrical connection.

27. The method of claim 25 wherein the coupling of the coupling element and the central conductor further comprises soldering the coupling element to the central conductor.

* * * * *